United States Patent [19]

Takanashi

[11] Patent Number: 4,756,319

[45] Date of Patent: Jul. 12, 1988

[54] PROCESS FOR PRODUCING GRANULAR ALGAL ADSORBENTS

[75] Inventor: Seizi Takanashi, Tokyo, Japan

[73] Assignee: C. S. Kogyo Company, Ltd., Tokyo, Japan

[21] Appl. No.: 744,187

[22] Filed: Jun. 13, 1985

[30] Foreign Application Priority Data

Aug. 30, 1984 [JP] Japan ..... 59-179303

[51] Int. Cl.[4] ..... A24D 3/14

[52] U.S. Cl. ..... 131/334; 131/341; 131/342

[58] Field of Search ..... 131/334, 331, 341, 342, 131/344

[56] References Cited

U.S. PATENT DOCUMENTS 4,269,204 12/1981 Yamaguchi .

FOREIGN PATENT DOCUMENTS 55-156584 12/1980 Japan .

*Primary Examiner*—V. Millin

*Attorney, Agent, or Firm*—Armstrong, Nikaido, Marmelstein & Kubovcik

[57] ABSTRACT

A process is described for the production of granular algal adsorbents having an average particle size of 0.1 to 10 mm, wherein an aqueous solvent is added to a mixture of 5 to 90 parts by weight of activated carbon having a particle size not larger than 2 mm and 10 to 95 parts by weight of algal powder composed of Chlorella and/or Spiruline, followed by granulation and drying. Adsorbents made by this process are effective filters for the removal of toxic and odiferous materials in smoke and air and are particularly useful in cigarette filters.

3 Claims, No Drawings

PROCESS FOR PRODUCING GRANULAR ALGAL ADSORBENTS

BACKGROUND OF THE INVENTION

1. Field of the Invention

This invention relates to adsorbents used in cigartte filters, air filters, protective masks, refrigerators and the like to remove harmful substances and disagreeable odor contained in cigarette smoke and air through adsorption.

2. Description of the Prior Arts

Conventional adsorbents used for such purposes are activated carbon, alumina, silica gel, zeolite and others. However, the substances to be adsorbed are very diverse in type. For example, cigarette smoke contains, other than nicotine, tar and carbon monoxide, 3,4-benzopyrene and other carcinogenic compounds; automotive and plant emissions contain various types of nitrogen oxides and sulfur oxides; and the air in refrigerators smells of various foodstuffs, often emitting unpleasant odor. When a variety of harmful or malodorous substances as mentioned above are present in air, it is difficult for any of the conventional adsorbents (activated carbon, etc.) to adsorb all of these at the same time. Adsorption activity of these adsorbents are also not sufficient.

Attempts have been made to use, in combination with the above-mentioned adsorbents, other substances that can effectively adsorb specific harmful or malodorous compounds, thus achieving adsorbent compositions with excellent adsorptive capacity.

Powder of algae, such as Chlorella and Spirulina, is one of substances used for this purpose, which is receiving attention for their unique adsorption activity against 3,4-benzopyrene and other harmful or malodorous compounds (U.S. Pat. No. 4,269,204 and Japanese Patent Laid-open No. 156584/1980).

The size of powder of these algae is very small; about 2 to 10$\mu$ in diameter for Chlorella, and $8\mu \times 400\mu$ for Spirulina. If the powder is used as such, effective contact with the harmful or malodorous compounds cannot be expected. The result is insufficient exhibition of their excellent adsorption activity.

When this minute powder is used as adsorbent in cigarette filters, in particular, the suction force exerted during smoking forces them to pass through the fibrous filter base, thus affecting cigarette taste.

The same is true also when the alga powder is employed in combination with commonly used adsorbents, such as activated carbon, alumina, silica gel and zeolite; segregation occurs between these two types of adsorbent components differing in size and specific gravity, nullifying the effect of incorporation of alga powder.

SUMMARY OF THE INVENTION

A object of this invention offers a means to fully exhibit the excellent adsorption acitivity of the powder of Chlorella and Spirulina by producing granular algal adsorbents which comprises adding an aqueous solvent to a mixture of active carbon and alga powder composed of Chlorella and/or Spirulina, followed by granulation and drying.

DETAILED DESCRIPTION OF THE INVENTION

This invention is directed to a process for producing granular algal adsorbents which comprises adding an aqueous solvent to a mixture of 5 to 90 parts by weight of active carbon having a particle size not larger than 2 mm and 10 to 95 parts by weight of alga powder composed of Chlorella and/or Spirulina, and granulating the resulting mixture, followed by drying, thereby giving granules having an average size an average size of 0.1 to 10 mm.

There is no limitation on the type of active carbon to be used in combination with the alga powder. Typical examples include powdery or granular activated carbon produced from wood, sawdust, coconut shells, coal such as lignite, peat and brown coal, and petroleum products such as bottoms, coke and pich. The particle size of activated carbon must not exceed 2 mm, and should preferably be in the range of 0.15 to 0.7 mm.

The mixing ratio of activated carbon to alga powder must be 5 to 95% by weight (preferably 20 to 50% by weight) of the former, and 10 to 95% by weight (preferably 50 to 80% by weight) of the latter. If the amount of alga powder is less than 10% by weight, the effect of its addition will be too low. If the amount exceeds 95% by weight, the effect of activated carbon will be too low and the product cost will be too high.

The activated carbon and alga powder are mixed and then shaped into granules by using an aqueous solvent.

For granulation of the mixture of activated carbon and alga powder, methods commonly used for the manufacture of granules, such as extrusion and fluidized bed techniques, may be employed.

When using the extrusion method, an aqueous solvent is added to a mixture of activated carbon and alga powder, the resulting mixture is kneaded in a kneader or other suitable mixing device, the kneaded product is extruded by means of an extrusion-type granulator, the extruded strands are crushed into a predetermined size and dried to remove the aqueous solvent, and the dried product is allowed to fragment naturally or is crushed into a desired size by a suitable cutting means, yielding a granular adsorbent composition.

In the process of this invention, it is preferable to throughly mix the activated carbon and algal powder prior to kneading in the presence of aqueous solvent to ensure high uniformity of the final product.

Preferred aqueous solvents are aqueous solutions of low-boiling alcohols, such as methanol, ethanol and propanol. When the final product is to be used as adsorbent in cigarette filters and refrigerators, an aqueous ethanol is most preferable in terms of safety, because there might be a trace of solvent left adsorbed in the final products after drying. The suitable alcohol concentration in the aqueous solvent is in the range of 30 to 70% by weight, preferably in the range of 45 to 50% by weight. Particularly, use of an aqueous solvent containing 45 to 50 weight-% alcohol has the advantage that the extruded strands tend to fragment naturally, thus eliminating the need for any artificial crushing operation.

The suitable amount of the aqueous solvent is in the range of 50 to 300 parts by weight, preferably in the range of 140 to 160 parts by weight, based on 100 parts by weight of the mixture of activated carbon and alga powder. Lower amounts often fail in shaping the composition into strand form. Excessive amounts, on the other hand, sometimes result in formation of mushy product after extrusion, also failing to give satisfactory strands.

The extruded strands are allowed to fragment naturally or are crushed by a suitable cutting means, and then submitted to the drying step.

Granulation can also be effected by the fluidized bed method, in which a fluidized bed composed of activated carbon and alga powder is formed in a fluidizer, and an aqueous solvent is sprayed to this fluidized bed. The mixing ratio of activated carbon to alga powder is the same as in the extrusion process described above. Preferable aqueous solvent in this case is water alone, or water containing a small amount of binder. As examples of the binders used in this process may be mentioned various kinds of starch such as potato starch, wheat starch and corn starch, various types of gums such as guar gum and gum arabic, dextrin, carboxy-methylcellulose, and other known binders.

The advantages of the fluidized bed method are simultaneous granulation and drying in a single equipment, larger surface area of final products compared with the extrusion process, and consequent higher adsorption activity. On the other hand, this method suffers from higher cost in small-lot production, and is therefore suited for mass-production.

The granules formed by the extrusion method are transferred to a dryer, where they are dried at 70° to 100° C. for four to seven hours to remove substantially all the alcohol used in the granulation step. In the fluidized bed method, on the other hand, drying is effected by further treatment in the fluidizer until the moisture content falls below 10%, preferably below 7%.

The dry granules thus obtained are then sifted for size adjustment. Though different depening on end uses, the suitable average particle size is in the range of 0.1 to 10 mm, and should preferably be in the range of 0.4 to 5 mm for cigarette filter application. If the average size exceeds 10 mm, the adsorption activity of the resultant granules will be poor. If the average size is lower than 0.1 mm, on the other hand, the permeability of the resultant adsorbent composition wil be too low, adversely affecting smooth passage of harmful or malodorous substances and defeating the effect intended by the use of adsorbent in granular form.

DETAILED DESCRIPTION OF THE PREFERRED EMBODIMENTS

This invention may be more fully understood from the following example.

Powder of Chlorella was intimately mixed with activated carbon having a particle size of 0.18 to 0.59 mm in the proportions shown in table 1. To 100 parts by weight of each mixture was added 150 parts by weight of 50 weight-% aqueous solution of ethanol, the resulting mixture was thoroughly kneaded in a kneader, and the kneaded product was charged in an extrusion-type granulator having a large number of nozzles 1 mmϕ in size. The strands emerging from the nozzles were allowed to fragment naturally, the fragments thus formed were spread in a dryer to a thickness of 1 to 2 cm and dried at 70° to 80° C. for five to eight hours, and the dried particles were sifted with 0.5 mm and 1.41 mm screens, giving the final product. The granules outside the above particule size range were recycled back to the feed mixture of activated carbon and Chlorella powder. The yield of Chlorella granules thus obtained was 90% on weight basis.

The granules (0.1 g) were uniformly dispersed in a piece of cigarette filter tip made of cellulose acetate 8 mm in diameter and 20 mm long. A plain cigarette measuring 8 mmϕ×180 mm was put to this filter tip, and the filter tipped cigarette thus prepared was tested on an automatic smoking machine (Heiner Borgwald Corporation) which repeats 2-second pulls at 30-seconds intervals (smoking flow rate: 17.5 ml/sec, smoking length: 40 mm). The amounts of nicotine, tar, 3,4-benzopyrene and carbon monoxide contained in the air passing through the test sample, as well as the permeation resistance of the filter tip and/or filter-tipped cigarette, were measured. Measurement was repeated five times, and the average of the five measurements was taken as the measured value. The result is summarized in Tables 1 and 2. Nicotine was determined by gas chromatography, tar by the gravimetric method, 3,4-benzopyrene by high-performance liquid chromatography, and carbon monoxide by means of the NDIR CO-analyzer.

TABLE 1

| Active Carbon/ Chlorella Weight Ratio in Granule | Nicotine | | Tar | | 3,4-Benzopyrene | | Carbon Monoxide | |
|---|---|---|---|---|---|---|---|---|
| | Amount (mg/piece) | Rate of Removal (%) | Amount (mg/piece) | Rate of Removal (%) | Amount (ng/piece) | Rate of Removal (%) | Amount (%) | Rate of Removal (%) |
| No filter | 2.2 | — | 25 | — | 7.6 | — | 6.95 | — |
| 40/60 | 1.63 | 25.9 | 15.6 | 37.6 | 0.45 | 94.1 | 6.11 | 12.1 |
| 20/80 | 1.47 | 33.2 | 15.4 | 38.4 | 0.43 | 94.3 | 4.96 | 28.6 |

TABLE 2

| Active Carbon/ Chlorella Weight Ratio in Granule | Permeation Resistance of Filter Tip ΔP (mm $H_2O$) | Permeation Resistance of Plain Cigarette ΔP (mm $H_2O$) | Permeation Resistance of Filter-tipped Cigarette ΔP (mm $H_2O$) | weight of Tobacco Leaf (g) |
|---|---|---|---|---|
| No Granule Added | 71 | 57 | 130.0 | 1.0703 |
| 40/60 | 72 | 59 | 132.2 | 1.0664 |
| 20/80 | 72 | 58 | 131.0 | 1.0683 |

The granular algal adsorbent compositions produced by the process of this invention, which consist of activated carbon and alga powder, have a large surface area and a specified particle size, with both of the two adsorptive components being evenly exposed on the surface of each granule. Thus, the resistance to permeation of fluids (particularly permeation resistance to gases) is kept low and, at the same time, there is more chance of harmful or malodorous substances contained in the fluid coming into contact with both the activated carbon and alga powder. As a result, the characteristic adsorption activity of activated carbon and alga powder can be fully exhibited, making the granules effective against a variety of harmful or malodorous substances.

What is claimed is:

1. A process for producing granular algal adsorbents which comprises adding 50 to 300 parts by weight of an aqueous solvent to 100 parts by weight of a mixture of 5 to 90% by weight of activated carbon having a particle size not larger than 2 mm and 10 to 95% by weight of alga powder selected from the group consisting of Chlorella and Spirulina, kneading the resulting mixture, extruding the kneaded product through an extrusion-type granulator having a nozzle size of 0.5 to 5 mmϕ, disintegrating the extruded strands naturally or crushing said extruded strands into a predetermined size by a suitable cutting means, and drying the fragments thus formed to remove said aqueous solvent, followed by classifying, thereby giving granules having an average size of 0.1 to 10 mm.

2. A process for producing granular algal adsorbents according to claim 1, wherein said aqueous solvent is a 30 to 70 weight-% aqueous solution of an alcohol.

3. A process for producing granular algal adsorbents according to claim 1, wherein said aqueous solvent is a 40 to 60 weight-% aqueous solution of ethanol, and its amount is 100 to 200 parts by weight based on 100 parts by weight of said mixture of activated carbon and alga powder.

* * * * *